US006652332B1

(12) United States Patent
Westhoff

(10) Patent No.: US 6,652,332 B1
(45) Date of Patent: Nov. 25, 2003

(54) REVERSE GATE FOR WATER JET PROPULSION SYSTEM

(75) Inventor: Paul E. Westhoff, Kenosha, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 10/319,433

(22) Filed: Dec. 13, 2002

Related U.S. Application Data

(60) Provisional application No. 60/339,684, filed on Dec. 13, 2001.

(51) Int. Cl.[7] ..... B63H 11/11
(52) U.S. Cl. ..... 440/41; 440/42
(58) Field of Search ..... 440/38–43

(56) References Cited

U.S. PATENT DOCUMENTS

| | | | | |
|---|---|---|---|---|
| 5,752,864 A | * | 5/1998 | Jones et al. | 440/41 |
| 6,428,370 B1 | * | 8/2002 | Jones | 440/38 |
| 2002/0052156 A1 | * | 5/2002 | Burg | 440/38 |

* cited by examiner

*Primary Examiner*—Jesus D. Sotelo
(74) *Attorney, Agent, or Firm*—Ziolkowski Patent Solutions Group, LLC

(57) ABSTRACT

A non-steerable reverse gate having a structure which reverses the lateral flow component when the steering nozzle is turned. The reverse gate produces high reverse and steering thrusts, while requiring low operating loads. The steering response in reverse is the same as an outboard or inboard/outboard. In effect, the transom thrusts to the side that the steering wheel is turned to. The reverse gate has a pair of flow-reversing passages for providing reverse thrust, a lateral steering passage for producing a lateral thrust when the steering nozzle is turned, and a fixed or pivotable central deflector body. The deflector body has three vertical walls connected to a juncture. One vertical wall is straight and extends forward of the juncture. The other vertical walls are curved and extend rearward and laterally outward from the juncture on opposite sides of a plane of symmetry. Each curved vertical wall has a flow-deflecting surface which is concave and faces a front opening of the reverse gate. The straight vertical wall splits the incoming flow into two streams, while the flow-deflecting surfaces divert portions of the respective streams toward the respective flow-reversing passages. Steering in reverse is provided by water which flow around the deflector body and out a discharge opening of the lateral steering passage.

26 Claims, 9 Drawing Sheets

| FIG.2A | FIG.2B |
|---|---|

REVERSE GATE FOR WATER JET PROPULSION SYSTEM

This application claims the benefit of Provisional Application No. 60/339,684 filed Dec. 13, 2001.

FIELD OF THE INVENTION

This invention generally relates to water jet apparatus for propelling boats and other watercraft. In particular, the invention relates to mechanisms for shifting a water jet apparatus to selectively propel a craft in the forward or reverse direction.

BACKGROUND OF THE INVENTION

It is known to propel a boat or other watercraft using a water jet apparatus mounted to the hull, with the powerhead being placed inside (inboard) the hull. An impeller is mounted on a shaft driven by a drive shaft of the motor, and is housed in a duct having an inlet and an outlet. The impeller is designed such that during motor operation, the rotating impeller impels water rearward through the duct. The water discharged from the duct outlet produces a thrust which propels the boat forward.

In addition, it is known to provide a mechanism for diverting the discharged water flow to one side or the other of a midplane, thereby enabling the boat operator to steer the boat to the left or right during forward propulsion. One such mechanism is a steering nozzle pivotably mounted to the duct and in flow communication with the duct outlet. Preferably the pivot axis of the steering nozzle lies in the midplane. As the steering nozzle is pivoted to the left of a central position, the water flow out of the duct is diverted leftward, producing a thrust which pushes the water jet apparatus and the boat stern to the right, thereby causing the bow of the boat to turn to the left. Similarly, the boat bow turns to the right when the steering nozzle is pivoted to the right of the central position.

It is also known to provide a mechanism for reversing the direction of the water flow exiting the steering nozzle. The reverse gate can be pivotably mounted to the steering nozzle, its pivot axis being generally perpendicular to the pivot axis of the steering nozzle. In the up position, the reverse gate is clear of the water flow exiting the steering nozzle. In the down position, the reverse gate is disposed in the path of the exiting water flow. In its simplest embodiment, the reverse gate has a U-shaped channel which reverses the water flow exiting the steering nozzle. In other words, when the steering nozzle is turned to the left, the resulting water flow having rearward and leftward flow components is redirected by the reverse gate to have forward and rightward components. This produces a thrust which pulls the boat rearward and propels the water jet apparatus and boat stern to the left, causing the boat to turn left during rearward movement. Similarly, the boat turns to the right during rearward movement when the steering nozzle is turned to the right. The provision of a steerable reverse gate allows the boat operator to steer in forward and reverse in the same manner that an automobile can be steered.

In accordance with other known designs, the reverse gate is not steerable, i.e., the reverse gate is pivotably mounted to the water jet housing. In the up position, the reverse gate is clear of the water flow exiting the steering nozzle; in the down position, the reverse gate obstructs the water flow exiting the steering nozzle and reverses the rearward flow component. Some non-steerable designs also reverse the lateral flow component; others do not. The non-steerable reverse gate designs which reverse the lateral flow component cause the rearward-moving boat to turn left when the steering nozzle is turned to the left and to turn right when the steering nozzle is turned to the right. However, these prior designs provide less than optimal reverse thrust and steering thrust. There is a need for a non-steerable reverse gate which reverses the lateral flow component, provides increased reverse and steering thrusts, and operates with low cable loads.

SUMMARY OF THE INVENTION

The present invention is directed to a non-steerable reverse gate having a structure which reverses the lateral flow component when the steering nozzle is turned. The reverse gates in accordance with the preferred embodiments produce high reverse and steering thrusts, while requiring low operating loads. The steering response in reverse is the same as an outboard or inboard/outboard. In effect, the transom thrusts to the side that the steering wheel is turned to. The invention is also directed to a water jet propulsion system having a non-steerable reverse gate of the foregoing type.

In accordance with one preferred embodiment of the invention, the reverse gate comprises a pair of flow-reversing passages for providing reverse thrust, a lateral steering passage for producing a lateral thrust when the steering nozzle is turned, and a fixed central deflector body. In accordance with another preferred embodiment, the central deflector body is pivotable about a vertical axis.

In accordance with both preferred embodiments disclosed herein, the flow-reversing passages are located on opposite (i.e., port and starboard) sides of the reverse gate. Each flow-reversing passage has an inlet and an outlet. The lateral steering passage is located aft of the deflector body and reversing passages and has discharge openings on opposite ends thereof, i.e., on the port and starboard sides of the reverse gate. The lateral steering passage communicates with the main chamber of the reverse gate via an aperture which is centered between port and starboard curved outer walls of the reverse gate. These port and starboard curved outer walls extend forward and laterally outward to form the outer side walls of the flow-reversing passages. The central aperture allows some of the water discharged from the steering nozzle to enter the lateral steering passage. The deflector is situated in front of the aperture to deflect some of the pump discharge to the sides and into the flow-reversing passages.

The deflector body in accordance with the first preferred embodiment of the invention comprises three vertical walls connected at a central vertical line located midway between the reversing passage inlets. The three vertical walls are preferably attached or joined to the top and bottom walls of the reverse gate housing. One vertical wall of the deflector body lies in the reverse gate midplane and extends forward from the central juncture of the walls. The other vertical walls of the deflector body are laterally curved in the shape of respective arcs. One arc curves from the central juncture toward the inlet of the reversing passage on the port side of the reverse gate; the other arc curves from the central juncture toward the inlet of the reversing passage on the starboard side of the reverse gate. These curved vertical walls will be referred to herein as flow-deflecting walls. The concave side of each flow-deflecting wall faces toward a wide opening in the front of the reverse gate, through which the water discharged from the steering nozzle outlet flows into the reverse gate. The flow-deflecting walls respectively guide or deflect incoming water toward the respective inlets of the opposing reversing passages. The incoming stream of water is split by the central vertical wall into two streams which respectively flow along the front surfaces of the curved vertical walls. In accordance with the preferred embodiment, the port surface of the central vertical wall and the front surface of the curved vertical wall on the port side form a continuous surface having a J-shaped contour which redirects one stream of incoming water toward the port reversing passage; similarly, the starboard surface of the central vertical wall and the front surface of the curved vertical wall on the starboard side form a continuous surface having a J-shaped contour which redirects the other stream of incoming water toward the starboard reversing passage.

In accordance with the first preferred embodiment, each curved vertical wall terminates at a sufficient distance from the opposing curved outer wall and each curved outer wall is suitably oriented, so that some water discharged from a steering nozzle steered to one side is directed by the curved outer wall on that side through the aperture and out the discharge opening on the opposite side of the lateral steering passage. Water which flows around the port curved vertical wall of the deflector body is directed to the starboard discharge opening of the lateral steering passage; while water which flows around the port curved vertical wall of the deflector body is directed to the starboard discharge opening of the lateral steering passage.

The deflector body in accordance with the second preferred embodiment has a shape similar to that of the first embodiment described above, i.e., three vertical walls connected at a vertical juncture to form back-to-back J shapes having a common spine. The deflector body of the second preferred embodiment differs from the deflector body of the first preferred embodiment in two respects: (1) the former is pivotable about a vertical axis, whereas the latter is fixed; and (2) the lateral span from the end of the port curved vertical wall to the end of the starboard curved vertical wall of the former is greater than the corresponding span of the latter. These differences are related in that the ability of the deflector body to pivot in either direction makes it possible to extend the length of the curved vertical walls without decreasing the gap between the end of the curved vertical wall and the curved outer wall on the opposite side. The longer laterally curved vertical walls of the deflector body increase the angle by which the incoming water is turned, direct more water into the flow-reversing passages. This increases reversing thrust significantly without diminishing the steering thrust.

For embodiments wherein the deflector body pivots about a vertical axis passing through the central vertical wall, the central vertical wall will be referred to as a leading rudder. When the steering nozzle is centered, the steering nozzle discharge is split by the leading rudder. The respective streams are then diverted into the respective flow-reversing passages by the respective flow-deflecting walls of the deflector body. Steering, i.e., turning the steering nozzle about its pivot axis, in one direction applies unequal forces on the two sides of the deflector body, causing it to pivot in the opposite direction. This allows some of the nozzle discharge on the other side of the leading rudder to miss the deflector body, escape around the backside, and then flow through the aperture behind the deflector body, into the lateral steering passage, and out the steering passage discharge opening on the same side toward which the deflector body has been turned. This design produces high steering thrust during flow reversal.

DETAILED DESCRIPTION OF THE PREFERRED EMBODIMENTS

Figures 1, 1A, 1B:
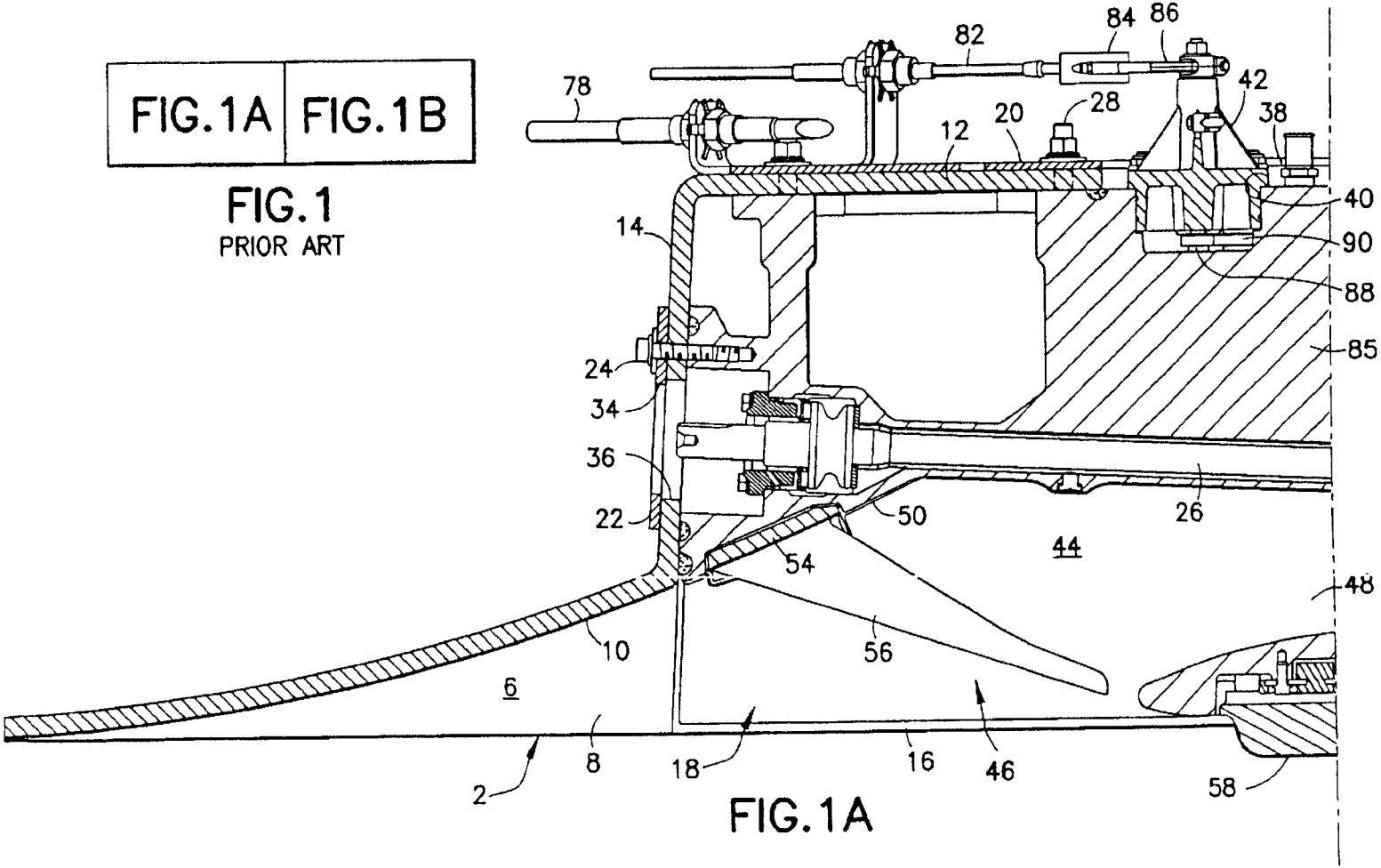
FIG.1 PRIOR ART
FIG. 1 is a schematic (presented in two sheets respectively labeled FIGS. 1A and 1B) showing a sectional view of a known water jet propulsion system mounted to a boat hull, the section being taken along a vertical midplane.
Figure 1B:
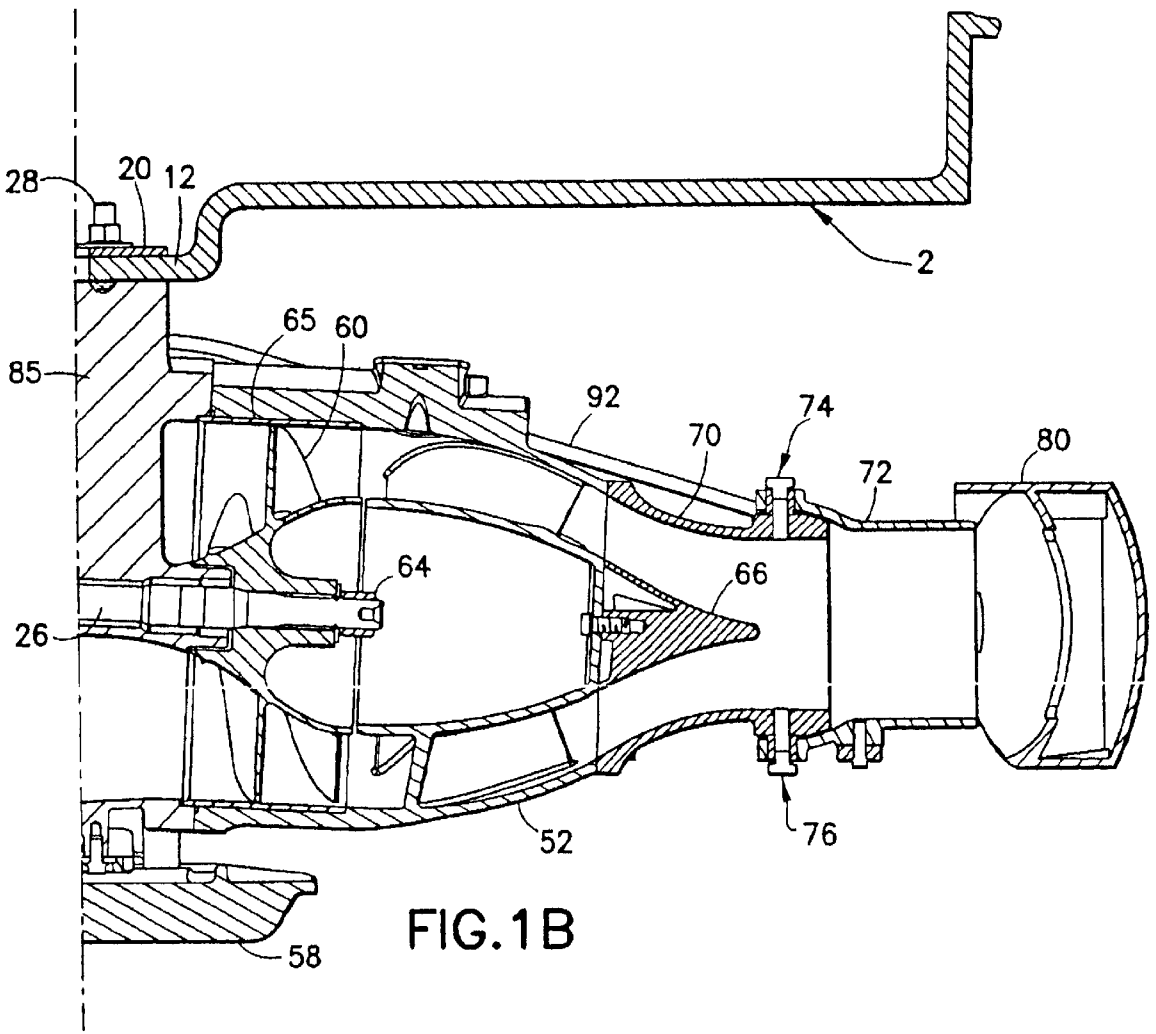
Figures 2, 2A:
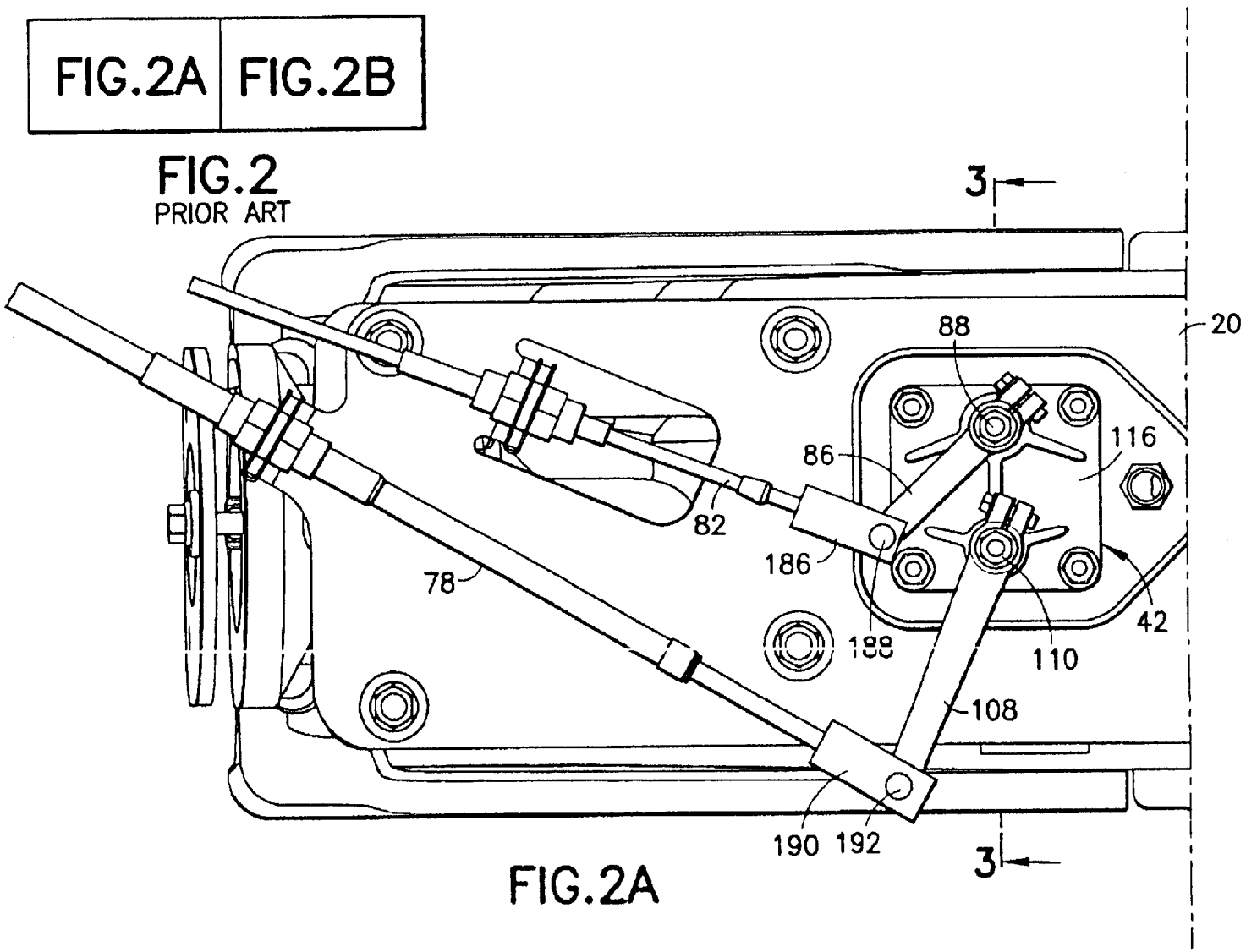
FIG.2 PRIOR ART
FIG. 2 is a schematic (presented in two sheets respectively labeled FIGS. 2A and 2B) showing a top view of the top mounting plate and the water jet apparatus depicted in FIG. 1, with the hull removed.
Figure 2B:
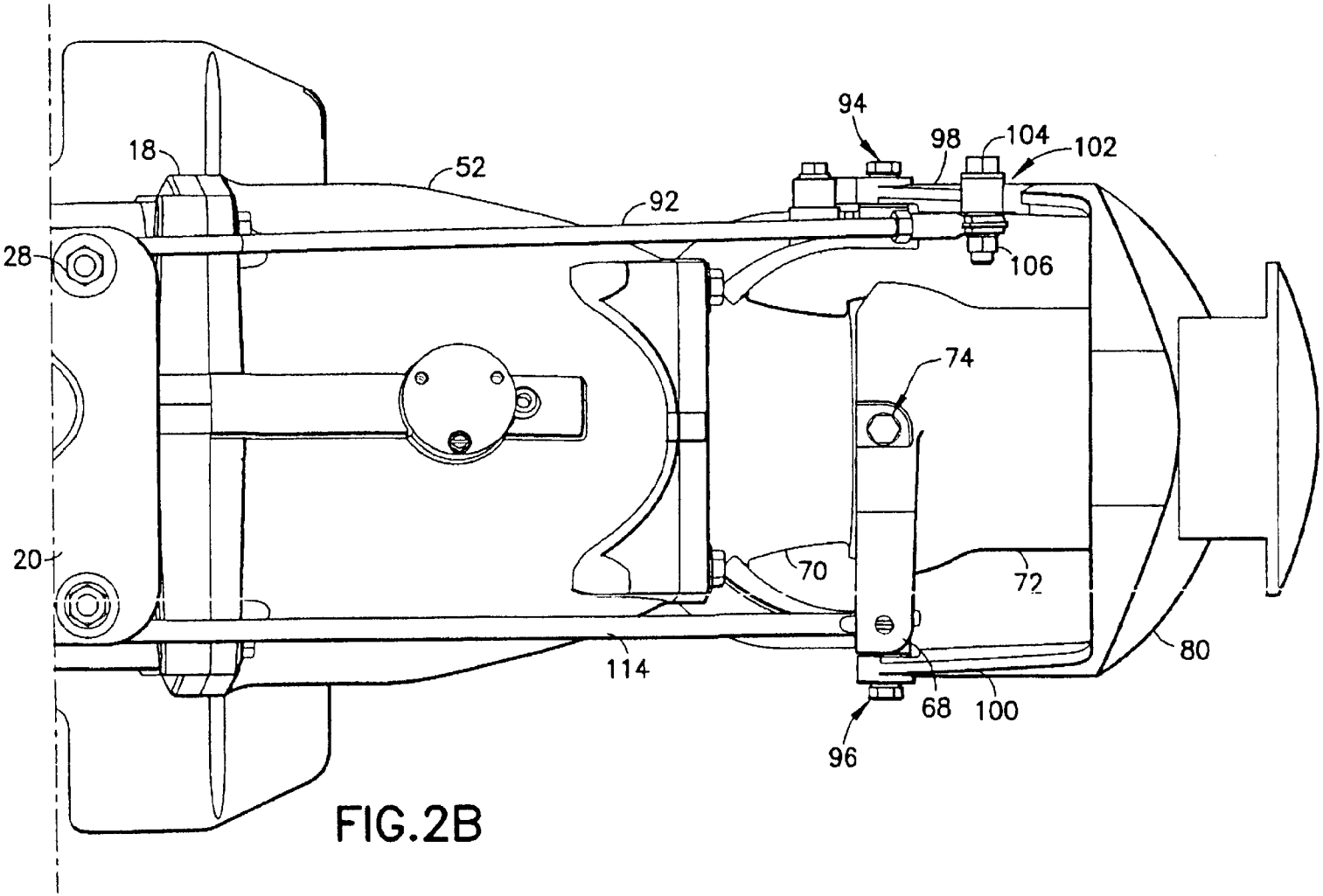
Figure 3:
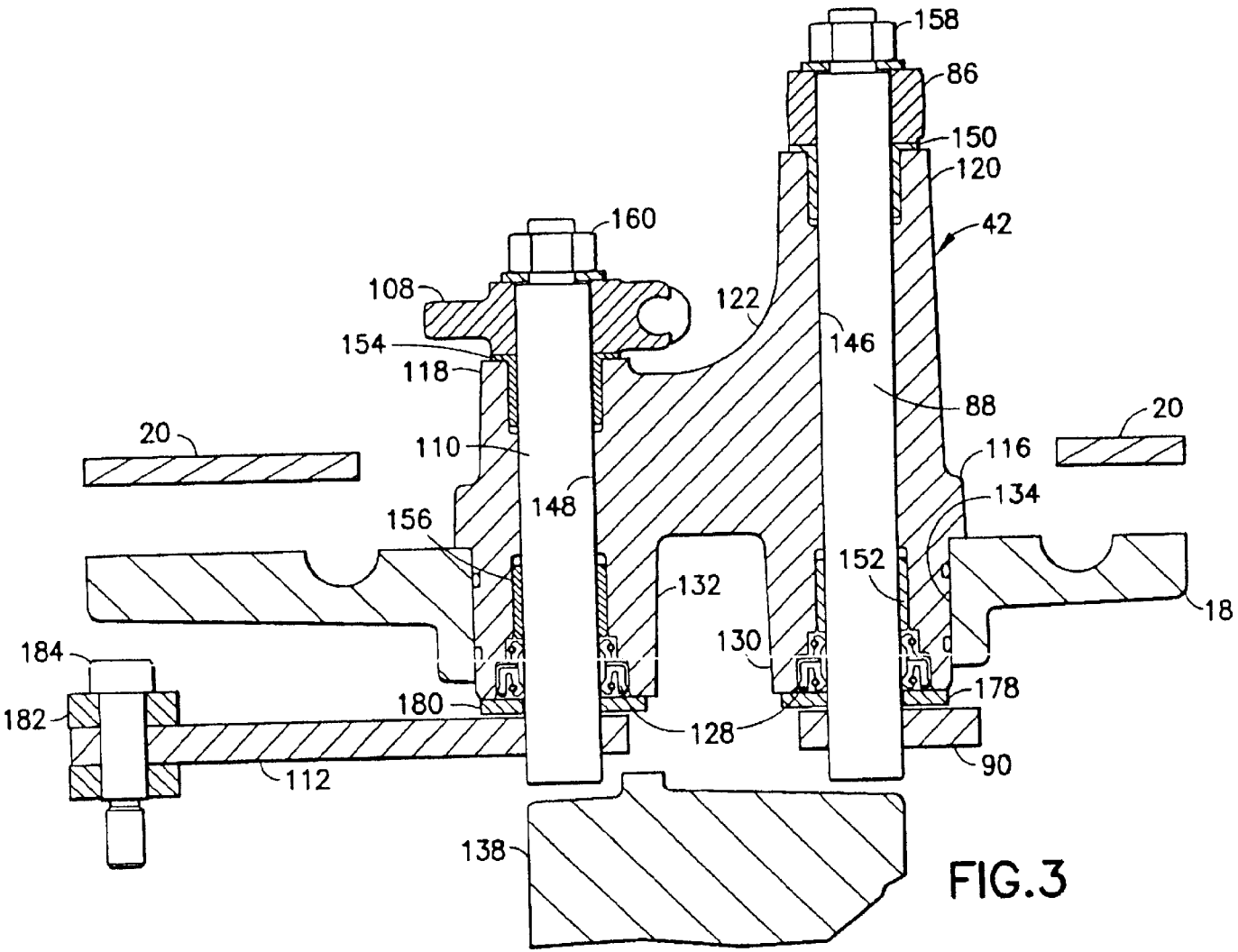
FIG. 3 is a schematic showing a sectional view of the shift and steering control housing shown in FIG. 2A, the section being taken along line 3—3 in FIG. 2A.

FIGS. 1 and 2 depict a prior water jet propulsion system which incorporates a steering nozzle and a reverse gate. These drawings show a basic structure for such a system, as well as one possible means for controlling the rotational positions of the steering nozzle and the reverse gate. The reverse gate shown in FIGS. 1B and 2B is not part of the present invention. The reverse gate in accordance with the preferred embodiments of the invention will be described in detail later with reference to FIGS. 4–10. FIGS. 1–3 are presented for the purpose of disclosing exemplary mechanisms for enabling a boat operator to remotely control the positions of a steering nozzle and reverse gate. However, it should be appreciated that the reverse gate of the invention can be utilized in water jet propulsion apparatus different in structure than that shown in FIGS. 1 and 2.

The water jet propulsion apparatus shown in FIG. 1 is designed to be installed in a cavity under a section of the hull and in flow communication with the outlet of an inlet ramp built into the hull. As seen in FIG. 1, the boat hull 2 has a inlet ramp 6 formed by a pair of opposing sidewalls 8 (only one of which is visible in FIG. 1) and a guide surface or ceiling 10 which curves gently upward in the aft direction. The end of the inlet ramp 6 communicates with a cavity in which the water jet propulsion apparatus is installed. This cavity is defined by a horizontal hull section 12, a vertical hull section 14 and a pair of opposing sidewalls 16 (only one of which is visible in FIG. 1), the cavity being open at the bottom and rear to allow insertion of the water jet propulsion apparatus.

The apparatus depicted in FIG. 1 comprises an inlet housing 18, which is slid into the aforementioned cavity and bolted to the hull by means of a top mounting plate 20 and a front plate 22. At the time of inlet housing installation, the drive shaft 26 is already rotatably mounted in the inlet housing. In particular, the inlet housing 18 comprises a vertical strut 85 having an axial bore which houses a portion of the drive shaft.

During inlet housing installation, the front plate 22 is placed on the inside of the vertical hull section 14 and the inlet housing 18 is placed on the outside of vertical hull section 14. Screws 24 (only one of which is visible in FIG. 1) hold the front plate, vertical hull section and inlet housing together. The front plate 22 has an opening 34 (best seen in FIG. 2) which, in the assembled state, is aligned with an opening 36 in the vertical hull section 14 to allow the output shaft (not shown) from the inboard motor to be coupled to the front end of the drive shaft 26. The studs 28 are affixed to the inlet housing 18. The inlet housing 18 is inserted into the hull cavity and the studs 28 are inserted into through-holes in the hull. The front plate 22 is then positioned and screws 24 are screwed into the inlet housing 18. The top mounting plate 20 is then placed over the studs 28 and secured to the hull. The top mounting plate 20 has an opening 38 which, in the assembled state, is aligned with an opening 40 in the horizontal hull section 12 to allow a shift and steering control housing 42 to be placed in a corresponding opening in the top wall of the inlet housing 18.

The inlet housing 18 has a water tunnel 44 with an inlet 46. The water tunnel 44 comprises a pair of sidewalls 48 (only one of which is shown in FIG. 1) which are generally coplanar with the sidewalls 8 of the hull inlet ramp 6. In addition, water tunnel 44 comprises a guide surface 50 which starts at a point near where the guide surface 10 of the hull inlet ramp 6 ends and then curves gradually upward in the aft direction. The hull 2 and the inlet housing 18 combine to form a single inlet for guiding water toward the inlet of a stator housing 52 located downstream of the inlet housing. An inlet grate 54, comprising a multiplicity of generally parallel tines 56, extends across the inlet 46 to prevent debris from entering. In addition, a ride plate 58 is attached to the bottom of the inlet housing 18.

As shown in FIG. 1, the drive shaft projects in the aft direction out of the inlet housing 18. The impeller is pre-assembled in the unit prior to mounting in the hull. The hub and blades of impeller 60 are preferably integrally formed as one cast piece. The hub of impeller 60 has a splined bore which meshes with splines formed on the external surface of the drive shaft 26, so that the impeller 60 will rotate in unison with the drive shaft. The impeller 60 is held on a threaded end of the drive shaft 26 by a threaded nut 64.

The stator housing 52 comprises inner and outer shells connected by a plurality of stator vanes, all integrally formed as a single cast piece. The stator vanes are designed to redirect the swirling flow out of the impeller 60 into non-swirling flow. A tail cone cover 66 is attached to the radial end face of the stator housing hub. The front of the stator housing 52 is then attached to the rear of the inlet housing 18. A circumferential recess in the stator housing 52 at a position opposing the impeller blade tips has a circular cylindrical wear ring 65 seated therein.

An exit nozzle 70 is attached to and in flow communication with the stator housing 52. Water from the stator housing 52 flows through the space between the tail cone cover 66 and the exit nozzle 70. A steering nozzle 72 is pivotably mounted to the exit nozzle 70 by a pair of pivot assemblies 74 and 76 having collinear axes. The steering nozzle 72 can be turned to change the direction of the water being discharged from the exit nozzle 70.

As best seen in FIG. 2B, the steering nozzle 72 has an arm 68 which is pivotably coupled to a flattened end of a steering rod 114. Displacement of the steering rod 114 in response to operation of a steering cable assembly 78 (see FIG. 2A) causes the steering nozzle 72 to swing in a desired direction about its vertical pivot axis.

The water jet apparatus shown in FIGS. 1 and 2 is provided with a non-steerable reverse gate 80, best seen in FIG. 2B. In the forward position, the reverse gate 80 is raised, thereby allowing water to exit the steering nozzle 72 freely. In the reverse position, the reverse gate 80 is lowered to a position directly opposite to the outlet of the steering nozzle 72. The reverse gate is designed to partially reverse the flow of water exiting the steering nozzle 72 when the reverse gate is in the reverse position. To accomplish the foregoing, the arms 98 and 100 of the reverse gate 80 are pivotably mounted to a pair of pivot assemblies 94 and 96 located on opposite sides of the exit nozzle 70 (see FIG. 2B). The support arms 98 and 100 are rigid members which connect to the exit nozzle 70. The reverse gate 80 is pivoted by a shift rod 92, the end of which is coupled to arm 98 of the reverse gate 80 by means of a rod end assembly 102 which comprises a ball socket for allowing horizontal radial motion at the shift lever and vertical radial motion at the reverse gate. The rod end assembly is attached to arm 98 by means of a screw 104 and a lock nut 106. Displacement of the shift rod 92 in response to operation of a shift cable assembly 82 (see FIG. 2A) causes the reverse gate to swing in a desired direction, namely, into forward position or reverse position, with a "neutral" position therebetween.

In the apparatus depicted in FIGS. 1 and 2, the shift and steering cable assemblies (located inside the hull) are respectively coupled to shift and steering rods (located outside the hull) by means of respective lever and shaft assemblies rotatably supported in a shift and steering control housing 42 which penetrates the hull. The shift and steering control housing 42 is installed in a corresponding opening in the top of the inlet housing 18. As seen in FIG. 2A, the housing 42 preferably comprises a base plate 116; as best seen in FIG. 3, the housing 42 further comprises an upper vertical tubular structures 118 and 120 extending above the base plate to different heights. The tubular structures 118 and 120 are reinforced by a rib 122. Additional reinforcement is provided by respective pairs of ribs visible in FIG. 2A. Referring again to FIG. 3, below the base plate 116, the housing has a circular cylindrical lower wall 128 integrally formed with lower vertical tubular structures 130 and 132. The lower wall 128 slides into a circular opening formed in the top wall of the inlet housing 18. The opening in the inlet housing communicates with the exterior of the water jet apparatus via a pair of opposing side channels through which the lower shift and steering levers (described below) respectively pass. Preferably the opening 40 (see FIG. 1A) in the horizontal hull section 12 closely matches the opening in mounting plate. As seen in FIG. 2A, the housing 42 is bolted to the inlet housing 18.

As seen in FIG. 3, the shift and steering control housing 42 has one bore 146 for receiving the shift shaft 88 and another bore 148 for receiving the steering shaft 110. The bore 146 has upper and lower annular recesses in which upper and lower bushings 150 and 152 are respectively inserted; the bore 148 has upper and lower annular recesses in which upper and lower bushings 154 and 156 are respectively inserted. The shift shaft 88 is rotatably supported in bushings 150 and 152, while steering shaft 110 is rotatably supported in bushings 154 and 156. One end of the upper shift lever 86 is secured to the top of the shift shaft 88 by means of a lock nut 158 which screws onto a threaded end of the shift shaft; one end of the upper steering lever 108 is secured to the top of the steering shaft 110 by means of a lock nut 160 which screws onto a threaded end of the steering shaft. (Only a portion of each of the upper levers is shown in FIG. 3.) The upper levers bear on the flanges of the upper bushings during rotation of the lever and shaft assemblies.

Still referring to FIG. 3, a lower shift lever 90 is welded to the bottom of the shift shaft 88, while a lower steering lever 112 is welded to the bottom of the steering shaft 110. A lower washer 178 is installed between the lower shift lever 90 and the lower vertical tubular structure 130 of the shift and steering control housing 42, while a lower washer 180 is installed between the lower steering lever 112 and the lower vertical tubular structure 132 of housing 42. The washers 178 and 180 provide a bearing surface. During assembly, the bottoms of the shafts are supported by a boss 138. The full length of the lower steering lever 112 is shown in FIG. 3, while only a portion of the lower shift lever 90 is depicted. FIG. 3 shows a clevis 182 and a shoulder screw 184 for attaching the distal end of the lower steering lever 112 to the forward end of the steering rod (not shown in FIG. 3). Similarly, the distal end of the lower shift lever is attached to the forward end of the shift rod by means of a clevis and shoulder screw coupling (not shown in FIG. 3).

Referring to FIG. 2A, the distal end of the upper shift lever 86 is attached to the shift cable assembly 82 by means of a clevis 186 and a clevis pin 188. These components are located inside the hull of the boat (see FIG. 1A). Displacement of the end of the shift cable assembly causes the shift lever and shaft assembly to rotate. Likewise the distal end of the upper steering lever 108 is attached to the steering cable assembly 78 by means of a clevis 190 and a clevis pin 192, and displacement of the end of the steering cable assembly causes the steering lever and shaft assembly to rotate. As best seen in FIG. 1A, the shift cable assembly 82 is supported by a bracket 194 and the steering cable assembly 78 is supported by a bracket 196, both brackets being integrally connected to and extending vertically upward from the top mounting plate 20. In response to operation of the steering cable assembly 78, the steering nozzle can be selectively turned left or right to steer the boat as desired during water jet operation. In response to operation of the shift cable assembly 82, the reverse gate can be selectively raised or lowered.

Figure 4:
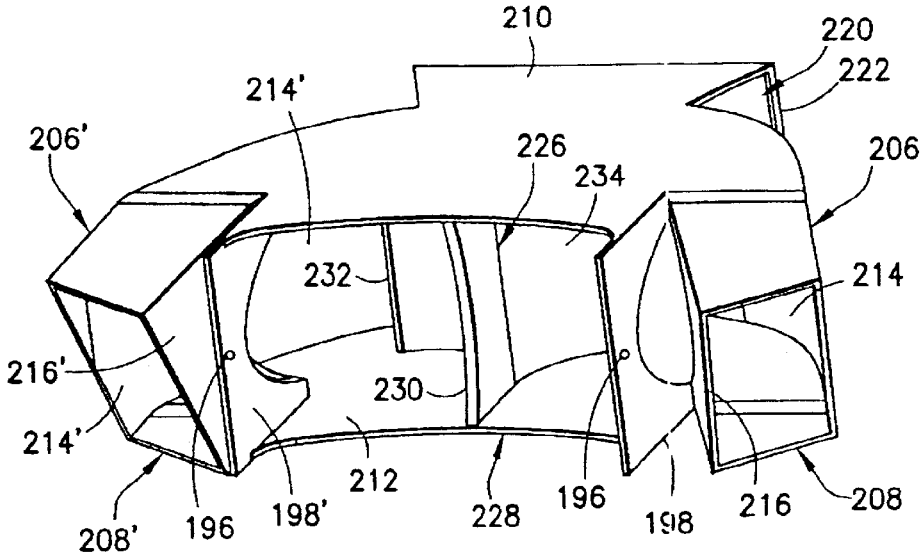
FIG. 4 is a schematic showing an isometric view of a reverse gate having a fixed deflector body in accordance with on preferred embodiment of the invention.
Figure 5:
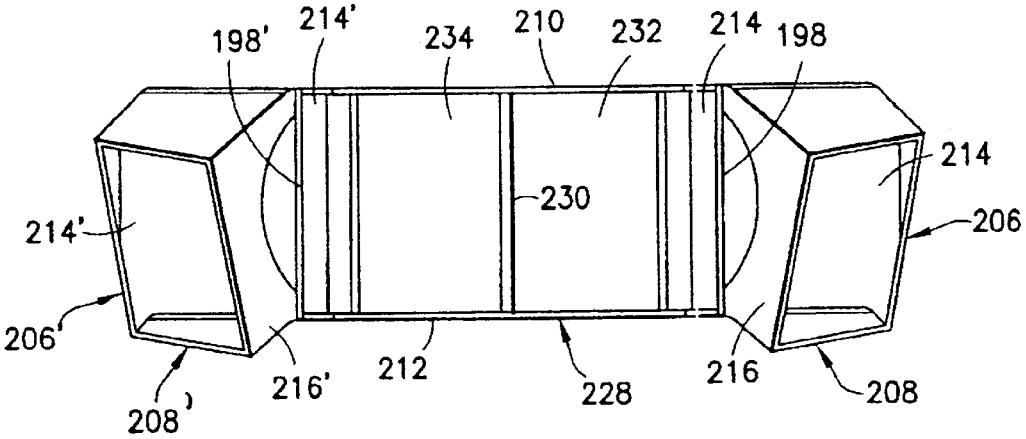
FIG. 5 is a schematic showing a front elevational view of the reverse gate depicted in FIG. 4.
Figure 6:
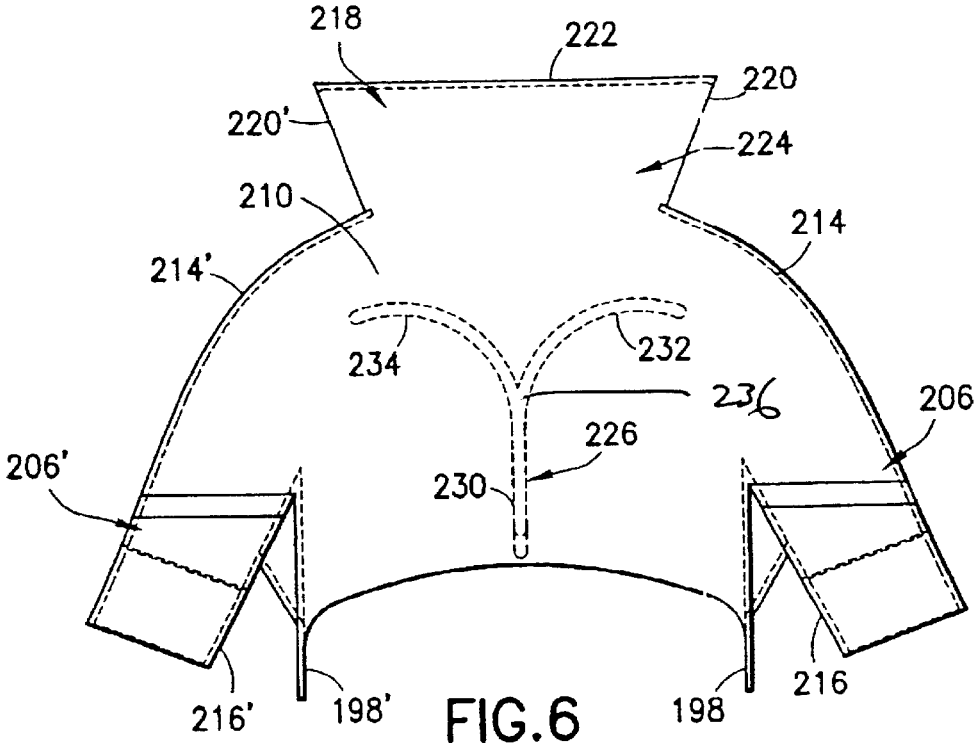
FIG. 6 is a schematic showing a plan view of the reverse gate depicted in FIGS. 4 and 5. The fixed deflector body is indicated by dashed lines.

In accordance with the preferred embodiments of the invention, the reverse gate is pivotably mounted to an exit nozzle or to an integral stator housing/exit nozzle, and is pivotable between first and second shift positions. The reverse gate in the first shift position is removed from the path of water exiting the exit nozzle and in the second shift position is disposed in the path of water exiting the exit nozzle. Reverse gates in accordance with first and second preferred embodiments of the invention are shown in FIGS. 4–6 and in FIGS. 7–10 respectively, with the pivot pin assemblies and the shift rod assembly for deploying the reverse gate not shown. As seen in those drawings, the housings for the two embodiments are substantially the same, while the major difference between the embodiments lies in the deflector body, which is fixed in the first embodiment and freely pivotable between limit stops in the second embodiment. Although not shown in the drawings, the invention also encompasses coupling the pivotable deflector body to the steering nozzle or to the means for turning the steering nozzle. The deflector body would be coupled to pivot in a direction opposite to the direction in which the steering nozzle was pivoted.

Figure 10:
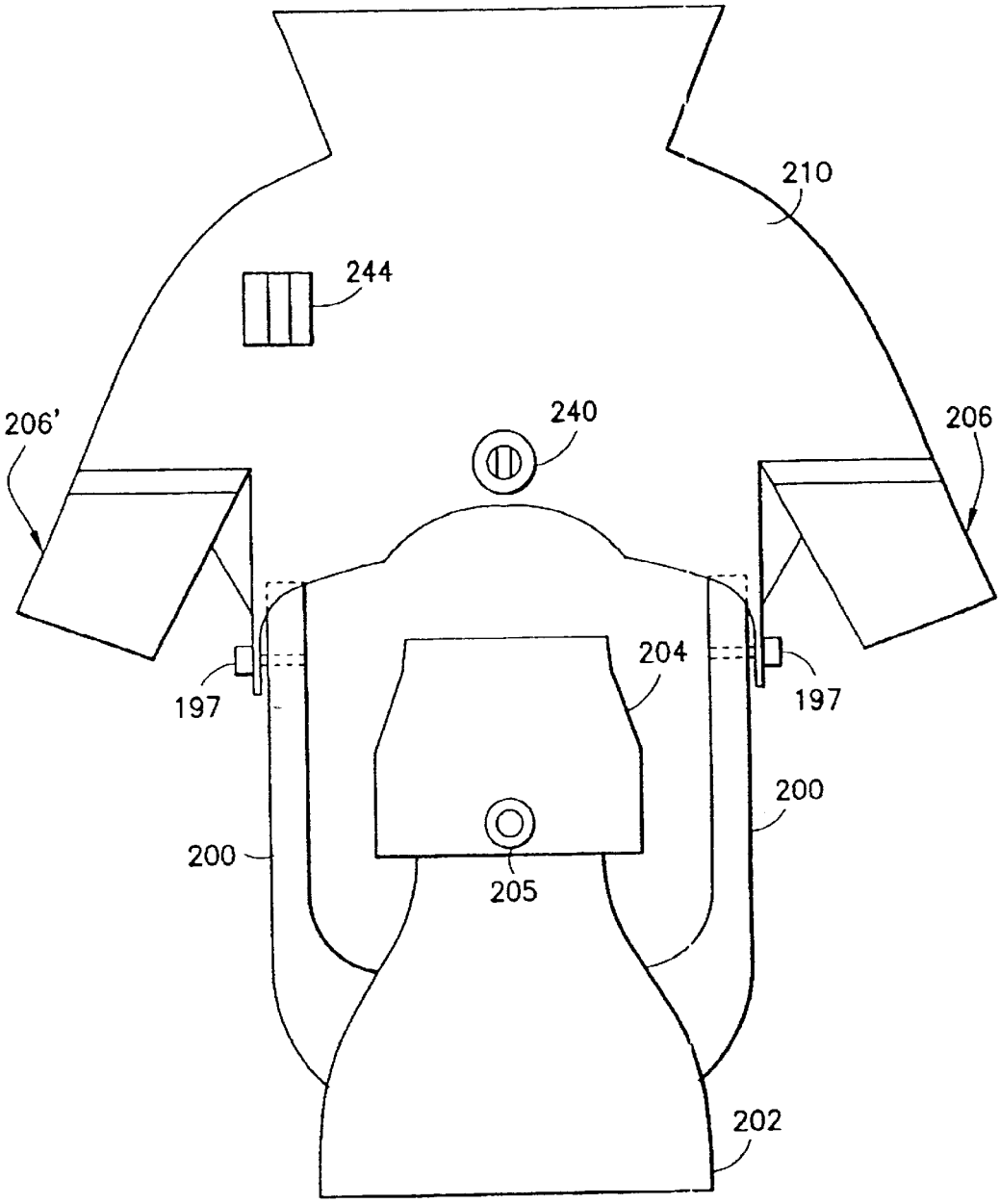
FIG. 10 is a schematic showing a plan view of the reverse gate in accordance with the second preferred embodiment mounted to a water jet propulsion system (only partly shown).

As seen in FIG. 4, pivot pins for pivotably supporting the reverse gate would be received in coaxial pivot holes 196 and 196' formed in mounting walls 198 and 198' respectively. The pivot pins 197 are shown in FIG. 10. The centerlines of the pivot pins 197 define the pivot axis. The reverse gate is deployed by actuating the previously described shifting rod (92 in FIG. 2B), which is coupled to the clevis 244 mounted to the top wall 210 of the reverse gate. The fully down position of the reverse gate is shown in FIG. 10. Preferably, the reverse gate is pivotably coupled to the ends of a pair of support arms 200 and 200' which extend from an integral stator housing/exit nozzle 202. The steering nozzle 204 is pivotably mounted to the exit nozzle by means of pivot pins 205, one of which is visible in FIG. 10. The reverse gate must be shaped to provide clearance between it and the steering nozzle during deployment.

Figure 7:
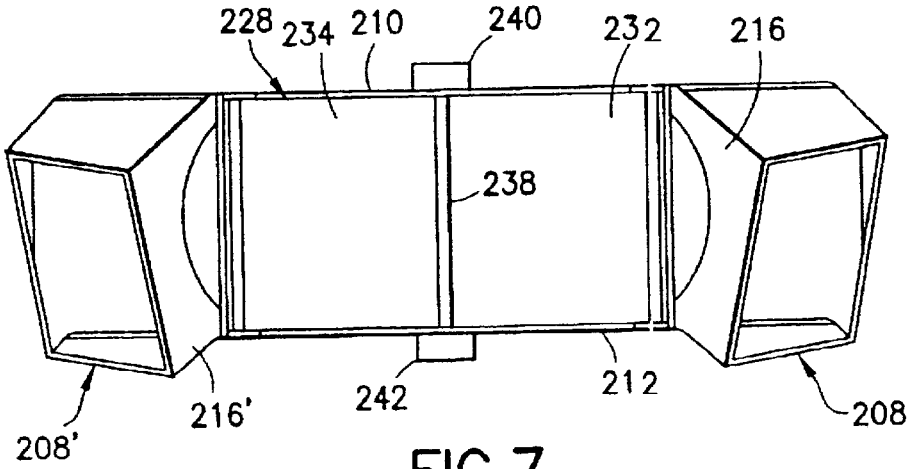
FIG. 7 is a schematic showing a front elevational view of a reverse gate having a pivotable deflector body in accordance with another preferred embodiment of the invention.

The reverse gates shown in FIGS. 4–10 each comprise port and starboard flow-reversing passages 206 and 206' having respective discharge openings 208 and 208'. As seen in FIGS. 5 and 7, the distal sections of the flow-reversing passages 206 and 206' are splayed downward and outward. Each of the flow-reversing passages 206 and 206' may have a generally rectangular cross section with sharp or rounded corners. In particular, the flow-reversing passages 206 and 206' are defined by respective portions of the top wall 210, respective portions of the bottom wall 212, respective portions of the port and starboard curved outer walls 214 and 214', and the port and starboard inner side walls 216 and 216' respectively.

Figure 8:
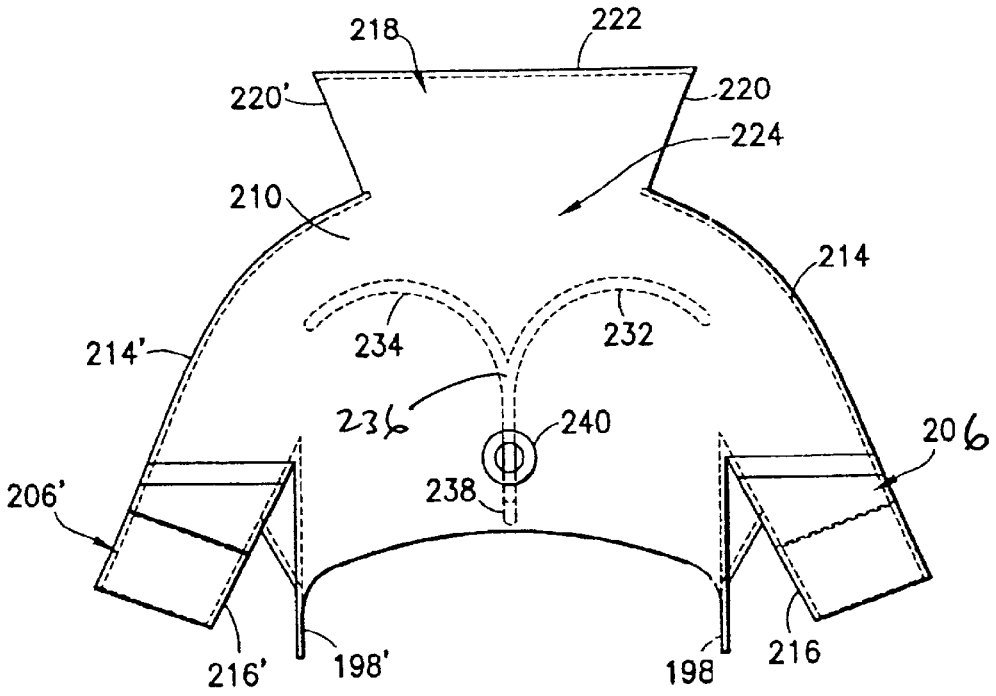
FIGS. 8 and 9 are schematics showing plan views of the reverse gate depicted in FIG. 7, with the deflector body in a central position (FIG. 8) and pivoted to starboard (FIG. 9).

In accordance with the preferred embodiments of the invention, the reverse gate further comprises a lateral steering passage 218 for producing a lateral thrust when the steering nozzle is turned. As best seen in FIGS. 6 and 8, the lateral steering passage 218 is located aft of the deflector body and reversing passages and has discharge openings 220 and 220' on opposite ends thereof, i.e., on the port and starboard sides of the reverse gate. The lateral steering passage 218 comprises an aft wall 222 which is laterally straight and aft portions of the top wall 210 and the bottom wall 212. The discharge openings 220 and 220' are defined by edges of the same walls in conjunction with respective portions of the curved outer walls 214 and 214', as seen in FIGS. 6 and 8. The lateral steering passage 218 communicates with the main chamber of the reverse gate via an aperture 224 which is centered between port and starboard curved outer walls 214 and 214' of the reverse gate. The curved outer walls 214 and 214' extend forward and laterally outward to form the outer side walls of the flow-reversing passages 206 and 206', respectively. The central aperture 224 allows some of the water discharged from the steering nozzle to enter the lateral steering passage 218.

As seen in FIGS. 5 and 7, in both embodiments a deflector body 226 is situated behind the front opening 228 in the reverse gate housing. The deflector body 226 is designed to split the incoming water discharged from the steering nozzle and divert the resulting streams to the port and starboard sides and toward the respective flow-reversing passages 206 and 206'.

Referring to FIG. 6, the deflector body 226 in accordance with the first preferred embodiment comprises three vertical walls 230, 232 and 234, connected along a vertical line to form a central juncture 236. The central juncture is located midway between the reversing passage inlets. The three vertical walls are preferably attached or joined to the top and bottom walls of the reverse gate housing. The flow-splitting wall 230 of the deflector body is longitudinally straight and preferably planar. The flow-splitting wall 230 lies in the reverse gate midplane and extends forward from the central juncture 236 of the walls. The flow-deflecting walls 232 and 234 of the deflector body are laterally curved in the shape of respective arcs. One arc 232 curves from the central juncture 236 toward the inlet of the reversing passage 206 on the port side of the reverse gate; the other arc 234 curves from the central juncture 236 toward the inlet of the reversing passage 206' on the starboard side of the reverse gate. The concave side of each flow-deflecting wall 232 and 234 faces toward the opening 228 in the front of the reverse gate. The flow-deflecting walls 232 and 234 respectively guide or deflect incoming water toward the respective inlets of the opposing reversing passages 206 and 206'. The incoming stream of water is split by the flow-splitting wall 230 into two streams which respectively flow along the front surfaces of the flow-deflecting walls 232 and 234. The port surface of the flow-splitting wall 230 and the front surface of the flow-deflecting wall 232 on the port side form a continuous surface having a J-shaped contour which redirects one stream of incoming water toward the port reversing passage 206; similarly, the starboard surface of the flow-splitting wall 230 and the front surface of the flow-deflecting wall 234 on the starboard side form a continuous surface having a J-shaped contour which redirects the other stream of incoming water toward the starboard reversing passage 206'.

In accordance with the first preferred embodiment, each flow-deflecting wall 232 or 234 terminates at a sufficient distance from the opposing curved outer wall 216 and 216', and each curved outer wall 214 and 214' is suitably oriented, so that some water discharged from the steering nozzle, when the latter is steered to one side, is directed by the curved outer wall on that side, through the aperture and out the discharge opening on the opposite side of the lateral steering passage. For instance, water which flows around the flow-deflecting wall 232 is directed to the starboard discharge opening 220' of the lateral steering passage; while water which flows around the flow-deflecting wall 234 is directed to the port discharge opening 220 of the lateral steering passage.

Thus the reverse gate in accordance with the first preferred embodiment shown in FIGS. 4–6 is able to produce reverse thrust and lateral steering thrust, the latter being directed so that the boat steers in reverse like an automobile.

Figure 9:
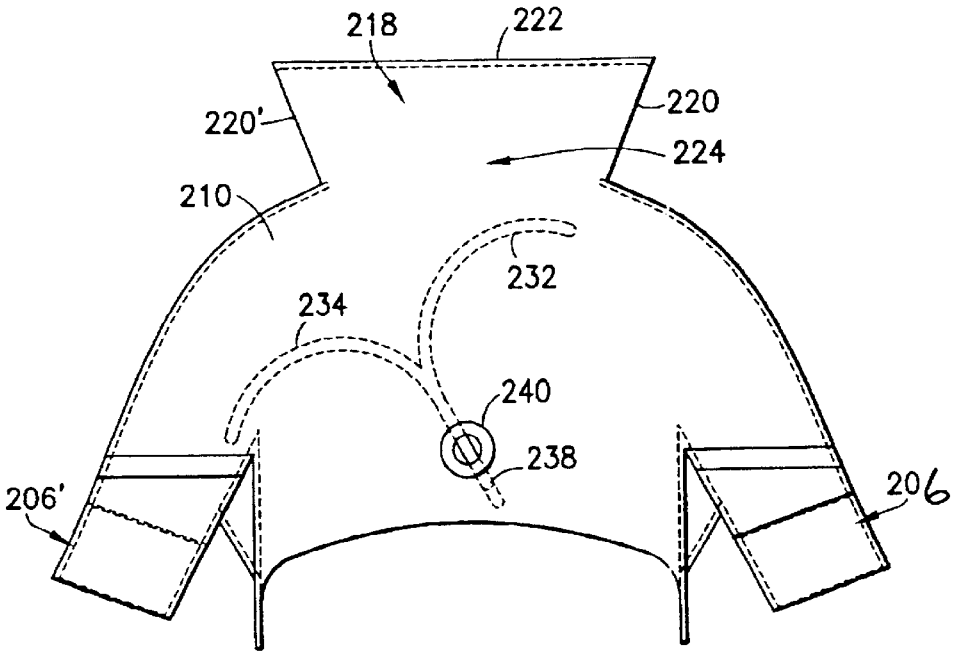

The deflector body in accordance with the second preferred embodiment, shown in FIGS. 7–9, has a shape similar to that of the first embodiment described above, i.e., three vertical walls connected at a vertical juncture to form back-to-back J shapes having a common spine. The deflector body of the second preferred embodiment differs from the deflector body of the first preferred embodiment in two respects: (1) the deflector body of the second embodiment is freely pivotable about a vertical axis between limit stops (the limit position is shown in FIG. 9), whereas the deflector body of the first embodiment was fixed; and (2) the angle of curvature (and lateral span) of each flow-deflecting wall of the second embodiment is greater than the angle of curvature (and lateral span) of the flow-deflecting walls of the first embodiment. These differences are related: pivoting of the deflector body in either direction makes it possible to extend the length of the flow-deflecting walls without decreasing the gap between the end of one flow-deflecting wall and the opposing curved outer wall 214 or 214'. Any decrease in the gap length would decrease the volume of water which can flow through the gap, other factors being equal. Also, the greater angle of curvature of the flow-deflecting walls allows more water to be diverted toward the flow-reversing passages. This increases reversing thrust significantly without diminishing the steering thrust.

In the case of a pivoting deflector body, the flow-splitting vertical wall 238 acts as a leading rudder. The leading rudder 238 is pivotably coupled to a pair of pivot pins 240 and 242, as shown in FIG. 7. Alternatively, the leading rudder can be mounted to a pivot shaft which passes through the leading rudder, the axis of the shaft lying in the plane of the rudder. Each of the flow-deflecting walls 232' and 234' extends along a circular arc having an angle greater than the arc angle in the first embodiment. The deflector body is pivotable about a vertical pivot axis between limit positions (one of which is shown in FIG. 9) dictated by limit stops strategically placed on the port and starboard sides of the reverse gate housing. For example, limit stops (not shown) may be integrally formed on the top or bottom wall of each flow-reversing passage.

The reverse gate in accordance with the second preferred embodiment operates as follows. When the steering nozzle 72 is centered as shown in FIG. 8, the steering nozzle discharge is split by the leading rudder 238. The respective streams are then diverted toward the respective flow-reversing passages 206 and 206' by the respective flow-deflecting walls 232 and 234 of the deflector body. Steering, i.e., turning the steering nozzle about its pivot axis, in one direction applies unequal forces on the two sides of the deflector body, causing it to pivot in the opposite direction. The leading rudder 238 still splits the incoming stream in two. The major portion of the nozzle discharge is directed to the side toward which the steering nozzle is turned; the remainder of the nozzle discharge is directed by the leading rudder to the opposite side. Because the deflector body is now turned, the tips of the flow-deflecting walls 232 and 234 are not symmetrically located. There is a large gap between the tip of the flow-deflecting wall in the path of the major stream, while the gap on the other side is substantially closed. In the example shown in FIG. 9, one part of the major stream is diverted toward the flow-reversing passage 206 on the port side; another part of the major stream will flow through the gap between the flow-deflecting wall 232 and the opposing outer curved wall 214 and then out the steering passage discharge opening 220' on the starboard side. Conversely, the majority of the nozzle discharge will flow out the discharge opening of the starboard flow-reversing passage and the port discharge opening of the steering passage when the steering nozzle is turned to starboard. This design produces high reverse thrust and high lateral steering thrust when the boat is shifted into reverse.

The deflector body in accordance with the preferred embodiments comprises a pair of vertical surfaces. One vertical surface extends straight from a first point adjacent the front opening to a second point located rearward of the first point and then curves along an arc from the second point to a third point. The other vertical surface extends straight from a fourth point adjacent the front opening to a fifth point located rearward of the fourth point and then curves along an arc from the fifth point to a sixth point. The first and fourth points are separated by the thickness of the leading edge of the deflector body. The arcs are equal to each other and preferably greater than 90 degrees. The third and sixth points are symmetrically located on opposing sides of a plane of symmetry defined by a plane midway between the straight portions of the vertical surfaces. The transitions from the straight portions to the curved portions at the second and fifth points are smooth. The deflector body preferably pivots freely over a range of angles dictated by the location of the limit stops. Alternatively, the pivotable deflector body may be coupled to have an angular position which is a function of the angular position of the steering nozzle.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "longitudinal" refers to a direction generally parallel to the centerline axis of a water jet propulsion system; the term "lateral" refers to a direction generally perpendicular to the longitudinal direction and generally parallel to a reverse gate pivot axis; and the term "vertical" refers to a direction generally perpendicular to the plane defined by the longitudinal and lateral axes. Also, as used in the claims, the term "duct" may comprise a single part or a plurality of assembled parts. For example, in the disclosed preferred embodiment, the inlet housing, stator housing and exit nozzle form a "duct". However, the present invention encompasses forming the inlet housing and stator housing as one piece, forming the stator housing and the exit nozzle as one piece, forming the inlet housing as two pieces, forming the stator housing as two pieces, and so forth. All such variations fall within the meaning of "duct" as that term is used in the claims.

What is claimed is:

1. A reverse gate comprising:

a housing having a front opening and comprising first and second flow-reversing passages arranged on opposing sides thereof, each of said first and second flow-reversing passages having an inlet and a discharge opening, and a lateral steering passage located in a rear portion of said housing, said lateral steering passage having discharge openings at opposite ends thereof; and a deflector body arranged inside said housing, said deflector body comprising a straight vertical wall and first and second curved vertical walls, each of said vertical walls being connected to a juncture, said straight vertical wall extending forward from said juncture, and said first and second curved vertical walls extending rearward and laterally outward from said junction, said first and second curved vertical walls extending along arcs on opposite sides of a plane which is generally co-planar with said straight vertical wall, the concave sides of said curved vertical walls generally facing said front opening and the convex sides of said curved vertical walls generally facing said lateral steering passage.

2. The reverse gate as recited in claim 1, wherein said deflector body is pivotably mounted to said housing.

3. The reverse gate as recited in claim 2, further comprising a pair of pivot pins coupled to said straight vertical wall for pivotably mounting said deflector body to said housing.

4. The reverse gate as recited in claim 2, wherein said deflector body pivots freely over a predetermined range of angles.

5. The reverse gate as recited in claim 1, wherein said straight vertical wall and said first curved vertical wall form a J shape.

6. The reverse gate as recited in claim 1, wherein said first and second curved vertical walls have shapes which mirror each other.

7. The reverse gate as recited in claim 1, wherein said housing comprises top and bottom walls connected by first and second curved outer walls on opposing sides thereof, forward portions of said first and second curved outer walls forming portions of said first and second flow-reversing passages respectively, and rear portions of said first and second curved outer walls partly forming said discharge openings of said lateral steering passage.

8. The reverse gate as recited in claim 7, wherein said first and second curved vertical walls have distal ends which do not contact said first and second curved outer walls respectively.

9. A reverse gate comprising:

a housing having a front opening and comprising first and second flow-reversing passages arranged on opposing sides thereof, each of said first and second flow-reversing passages having an inlet and a discharge opening, and a lateral steering passage located in a rear portion of said housing, said lateral steering passage having discharge openings at opposite ends thereof; and a deflector body arranged inside said housing, said deflector body comprising first and second vertical surfaces, said first vertical surface extending straight from a first point adjacent said front opening to a second point located rearward of said first point and then curving along a first arc from said second point to a third point, and said second vertical surface extending straight from a fourth point adjacent said front opening to a fifth point located rearward of said fourth point and then curving along a second arc from said fifth point to a sixth point, wherein said first and fourth points are separated by a thickness of a leading edge of said deflector body, said first and second arcs are equal to each other, and said third and sixth points are symmetrically located on opposing sides of a plane of symmetry defined by a plane midway between said straight portions of said first and second vertical surfaces.

10. The reverse gate as recited in claim 9, wherein the transitions from said straight portions to said curved portions at said second and fifth points are smooth.

11. The reverse gate as recited in claim 9, wherein said first and second arcs are each greater than 90 degrees.

12. The reverse gate as recited in claim 9, wherein said deflector body is pivotably mounted to said housing.

13. The reverse gate as recited in claim 12, further comprising a pair of pivot pins coupled to said deflector body along a section having said straight portions on opposing sides thereof.

14. The reverse gate as recited in claim 12, wherein said deflector body pivots freely over a predetermined range of angles.

15. The reverse gate as recited in claim 9, wherein each of said first and second vertical surfaces forms a J shape.

16. The reverse gate as recited in claim 9, wherein said housing comprises top and bottom walls connected by first and second curved outer walls on opposing sides thereof, forward portions of said first and second curved outer walls forming portions of said first and second flow-reversing passages respectively, and rear portions of said first and second curved outer walls partly forming said discharge openings of said lateral steering passage.

17. The reverse gate as recited in claim 9, wherein a distal end of said curved portion of said first vertical surface is directed toward said inlet of said first flow-reversing passage, and a distal end of said curved portion of said second vertical surface is directed toward said inlet of said second flow-reversing passage.

18. A water jet propulsion system comprising:

a duct having an inlet and an outlet;

an impeller which is rotatable within said duct;

a steering nozzle pivotably mounted to an outlet end of said duct and having an inlet and an outlet, said steering nozzle being pivotable between first and second steering positions, and said steering nozzle inlet being in flow communication with said duct outlet; and a reverse gate pivotably mounted to said duct, said reverse gate being pivotable about a pivot axis between first and second shift positions, said reverse gate in said first shift position being removed from the path of water exiting said steering nozzle outlet and in said second shift position being in the path of water exiting said steering nozzle outlet, wherein said reverse gate comprises:

a housing having a front opening which faces said steering nozzle outlet when said reverse gate is in said second shift position, said housing comprising first and second flow-reversing passages arranged on opposing sides thereof, each of said first and second flow-reversing passages having an inlet and a discharge opening, and a lateral steering passage located in an aft portion of said housing, said lateral steering passage having discharge openings at opposite ends thereof; and a deflector body arranged inside said housing, said deflector body comprising a straight vertical wall and first and second curved vertical walls, each of said vertical walls being connected to a juncture, said straight vertical wall extending forward from said juncture, and said first and second curved vertical walls extending rearward and laterally outward from said junction, said first and second curved vertical walls extending along arcs on opposite sides of a plane which is generally co-planar with said straight vertical wall, the concave sides of said curved vertical walls generally facing said front opening and the convex sides of said curved vertical walls generally facing said lateral steering passage.

19. The water jet propulsion system as recited in claim 18, wherein said deflector body is pivotably mounted to said housing.

20. The water jet propulsion system as recited in claim 19, wherein said deflector body pivots freely over a predetermined range of angles.

21. The water jet propulsion system as recited in claim 18, wherein said housing comprises top and bottom walls connected by first and second curved outer walls on opposing sides thereof, forward portions of said first and second curved outer walls forming portions of said first and second flow-reversing passages respectively, and rear portions of said first and second curved outer walls partly forming said discharge openings of said lateral steering passage.

22. A water jet propulsion system comprising:

a duct having an inlet and an outlet;

an impeller which is rotatable within said duct;

a steering nozzle pivotably mounted to an outlet end of said duct and having an inlet and an outlet, said steering nozzle being pivotable between first and second steering positions, and said steering nozzle inlet being in flow communication with said duct outlet; and a reverse gate pivotably mounted to said duct, said reverse gate being pivotable about a pivot axis between first and second shift positions, said reverse gate in said first shift position being removed from the path of water exiting said steering nozzle outlet and in said second shift position being in the path of water exiting said steering nozzle outlet, wherein said reverse gate comprises: a housing having a front opening which faces said steering nozzle outlet when said reverse gate is in said second shift position, said housing comprising first and second flow-reversing passages arranged on opposing sides thereof, each of said first and second flow-reversing passages having an inlet and a discharge opening, and a lateral steering passage located in an aft portion of said housing, said lateral steering passage having discharge openings at opposite ends thereof; and a deflector body pivotably mounted inside said housing.

23. The water jet propulsion system as recited in claim 22, wherein said deflector body pivots freely over a predetermined range of angles.

24. The water jet propulsion system as recited in claim 22, wherein said deflector body comprises a straight vertical wall and first and second curved vertical walls, each of said vertical walls being connected to a juncture, said straight vertical wall extending forward from said juncture, and said first and second curved vertical walls extending rearward and laterally outward from said junction, said first and second curved vertical walls extending along arcs on opposite sides of a plane which is generally co-planar with said straight vertical wall, the concave sides of said curved vertical walls generally facing said front opening and the convex sides of said curved vertical walls generally facing said lateral steering passage.

25. The water jet propulsion system as recited in claim 22, wherein said deflector body comprises first and second vertical surfaces, said first vertical surface extending straight from a first point adjacent said front opening to a second point located rearward of said first point and then curving along a first arc from said second point to a third point, and said second vertical surface extending straight from a fourth point adjacent said front opening to a fifth point located rearward of said fourth point and then curving along a second arc from said fifth point to a sixth point, wherein said first and fourth points are separated by a thickness of a leading edge of said deflector body, said first and second arcs are equal to each other, and said third and sixth points are symmetrically located on opposing sides of a plane of symmetry defined by a plane midway between said straight portions of said first and second vertical surfaces.

26. A water jet propulsion system comprising:

a duct having an inlet and an outlet;

an impeller which is rotatable within said duct;

a steering nozzle pivotably mounted to an outlet end of said duct and having an inlet and an outlet, said steering nozzle being pivotable between first and second steering positions, and said steering nozzle inlet being in flow communication with said duct outlet; and a reverse gate pivotably mounted to said duct, said reverse gate being pivotable about a pivot axis between first and second shift positions, said reverse gate in said first shift position being removed from the path of water exiting said steering nozzle outlet and in said second shift position being in the path of water exiting said steering nozzle outlet, wherein said reverse gate comprises:

a housing having a front opening which faces said steering nozzle outlet when said reverse gate is in said second shift position, said housing comprising first and second flow-reversing passages arranged on opposing sides thereof, each of said first and second flow-reversing passages having an inlet and a discharge opening, and a lateral steering passage located in an aft portion of said housing, said lateral steering passage having discharge openings at opposite ends thereof; and a deflector body mounted inside said housing, said deflector body comprising first and second vertical surfaces, said first vertical surface extending straight from a first point adjacent said front opening to a second point located rearward of said first point and then curving along a first arc from said second point to a third point, and said second vertical surface extending straight from a fourth point adjacent said front opening to a fifth point located rearward of said fourth point and then curving along a second arc from said fifth point to a sixth point, wherein said first and fourth points are separated by a thickness of a leading edge of said deflector body, said first and second arcs are equal to each other, and said third and sixth points are symmetrically located on opposing sides of a plane of symmetry defined by a plane midway between said straight portions of said first and second vertical surfaces.

* * * * *